US007832230B2

(12) United States Patent
Feldhaus et al.

(10) Patent No.: US 7,832,230 B2
(45) Date of Patent: Nov. 16, 2010

(54) CONDENSER FOR AN AIR-CONDITIONING SYSTEM, PARTICULARLY FOR A MOTOR VEHICLE

(75) Inventors: Georg Feldhaus, Stuttgart (DE); Uwe Förster, Erdmannhausen (DE); Martin Kaspar, Fellbach (DE); Kurt Molt, Bietigheim-Bissingen (DE)

(73) Assignee: Behr GmbH & Co, KG, Stuttgart (DE)

( * ) Notice: Subject to any disclaimer, the term of this patent is extended or adjusted under 35 U.S.C. 154(b) by 328 days.

(21) Appl. No.: 11/568,657

(22) PCT Filed: May 4, 2005

(86) PCT No.: PCT/EP2005/004855

§ 371 (c)(1),
(2), (4) Date: Aug. 22, 2007

(87) PCT Pub. No.: WO2005/108896

PCT Pub. Date: Nov. 17, 2005

(65) Prior Publication Data

US 2008/0156012 A1 Jul. 3, 2008

(30) Foreign Application Priority Data

May 5, 2004 (DE) ..... 10 2004 022 714

(51) Int. Cl.
*F25B 43/00* (2006.01)

(52) U.S. Cl. ..... 62/509; 62/509

(58) Field of Classification Search ..... 62/509, 62/512, 474, 513; 165/132, 110
See application file for complete search history.

(56) References Cited

U.S. PATENT DOCUMENTS

| | | | | |
|---|---|---|---|---|
| 6,295,832 | B1 * | 10/2001 | Kato et al. | 62/509 |
| 6,341,647 | B1 * | 1/2002 | Nobuta et al. | 62/509 |
| 6,349,562 | B1 | 2/2002 | Kaspar et al. | |
| 6,851,468 | B2 | 2/2005 | Kaspar et al. | |
| 2002/0046571 | A1 | 4/2002 | Bernini | |

FOREIGN PATENT DOCUMENTS

| | | | |
|---|---|---|---|
| DE | 100 39 260 | A1 | 3/2001 |
| DE | 10 2004 017 002 | A1 | 11/2004 |
| EP | 07 69 666 | A1 | 4/1997 |
| EP | 1 202 007 | A1 | 5/2002 |
| EP | 1 219 907 | A2 | 7/2002 |
| EP | 1 223 391 | A1 | 7/2002 |
| EP | 1 310 748 | A2 | 5/2003 |
| EP | 1 464 901 | A2 | 10/2004 |
| JP | 4-139364 | A | 5/1992 |
| JP | 5-26539 | A | 2/1993 |
| JP | 2000-304489 | A | 11/2000 |
| JP | 2001-174103 | A | 6/2001 |

* cited by examiner

*Primary Examiner*—Mohammad M Ali
(74) *Attorney, Agent, or Firm*—Bachman & LaPointe, P.C.

(57) ABSTRACT

The invention relates to a condenser for an air-conditioning system, particularly for a motor vehicle, with vertically arranged tubes, through which a coolant can flow and which are connected to an upper and a lower horizontally arranged manifold whereby permitting the flow of coolant. The inventive condenser also comprises a collector parallelly arranged underneath the lower manifold and, via an inflow opening and an outflow opening, between which a separating device is placed, is connected to the manifold in a manner that permits the flow of coolant. The collector accommodates a filtering and/or drying device. The separating device has a suction device for, in essence, liquid coolant.

18 Claims, 3 Drawing Sheets

CONDENSER FOR AN AIR-CONDITIONING SYSTEM, PARTICULARLY FOR A MOTOR VEHICLE

BACKGROUND OF THE INVENTION

The invention relates to a condenser for an air conditioning system, in particular for a motor vehicle.

Condensers are components of a coolant circuit for an air conditioning system, the condenser in air conditioning systems for motor vehicles often being arranged and mounted in the front region of the engine cavity together with a coolant radiator. Condensers are known as cross flow condensers, i.e. with coolant pipes which are arranged horizontally and through which coolant flows, as well as drop flow condensers with coolant pipes which are arranged vertically and through which coolant flows. Both types of condensers are known from EP-A-769 666. Condensers have manifold pipes in which the coolant pipes open, the manifold pipes being divided by separating walls in order to bring about a multi-current, meandering flow of coolant through the condenser. The condenser is generally composed of a condensation section and a lower cooling section in which coolant which is already liquefied is cooled below the condensation temperature. The condenser is assigned a manifold which is arranged parallel to one of the manifold pipes and communicates on the coolant side with the manifold pipe. The manifold accommodates a filter device and/or drying device and has, inter alia, the function of separating the gaseous and liquid phases of the coolant so that as far as possible only liquid coolant is fed to the lower cooling section of the condenser. For cross flow condensers this task has already been solved in many ways, specifically by means of vertically arranged manifolds in which the liquid phase of the coolant collects at the bottom owing to the difference in density and the gaseous phase of the coolant rises into the upper region of the manifold. In the case of drop flow condensers the problem of phase separation cannot be solved in an analogous way—in EP-A 769 666, for example, a vertically arranged manifold with horizontally arranged manifold pipes has been proposed for a drop flow condenser (exemplary embodiment according to FIG. 7). This solution clearly takes up considerable installation space, in particular in the direction of airflow, i.e. the direction of travel of the vehicle.

In the earlier patent application by the applicant DE 103 15 374, whose disclosure content is part of the content of the present application documents, a drop flow condenser, i.e. one with vertically arranged coolant pipes (referred to as through-flow devices) and horizontally arranged manifold pipes with an integrated manifold at the bottom is disclosed. The manifold has an inflow chamber with an inflow opening and an outflow chamber with an outflow opening, a separating device being provided in both chambers, between the inflow and outflow openings, and having an overflow opening for liquid coolant in its region which is located geodetically at the bottom. The gaseous phase of the coolant is essentially in the upper half of the manifold, i.e. in the region which is located geodetically higher, thus separating the two phases.

SUMMARY OF THE INVENTION

The object of the present invention is to improve a condenser of the type mentioned at the beginning, i.e. a drop flow condenser with integrated manifold located at the bottom, to such an extent that effective separation of the gaseous and liquid phases of the coolant is achieved with simple means.

This object is achieved by means of the features described herein. According to the invention, the separating device in the manifold has an extractor device which is preferably embodied as an extraction pipe and extends in the longitudinal direction of the manifold. This provides the advantage of effective extraction of liquid coolant without additional installation space being taken up.

In one advantageous embodiment of the invention, the extraction pipe leads through the filter device and/or drying device, specifically into a reservoir space in which coolant in the liquid phase collects in the geodetically lower region. It is advantageous here that the coolant is sucked out to a location at which the highest liquid level (level for liquid coolant) occurs.

According to one advantageous embodiment, the extraction pipe has a tube or a downwardly opened cap at its end which projects into the reservoir space, thus permitting liquid coolant to be effectively extracted.

According to one advantageous embodiment of the invention, the separating device is embodied as a stopper with a through-duct for the liquid coolant to be extracted. The through-duct is connected at one end to the extraction pipe and at the other end to the outflow opening in the manifold; it advantageously has a right-angled deflection means, produced by an axially extending longitudinal bore and a radially extending transverse bore. This causes the extracted, liquid coolant to be channeled to in front of the outflow opening and prevents gaseous components of the coolant from being carried along.

According to one advantageous embodiment, the stopper is adapted in its cross section to the cross section of the manifold, pushed into said manifold in the longitudinal direction and sealed with respect to the inner wall of the manifold by means of an O ring. This provides the advantage that gaseous coolant does not flow around the stopper in the axial direction and get into the outflow opening, i.e. into the lower cooling section of the condenser.

According to a further advantageous embodiment of the invention, the filter device and/or drying device is arranged in the manifold in such a way that a positive through-flow is brought about away from the inflow opening in the direction of the supply chamber. The coolant flow which enters the manifold through the inflow opening contains gaseous components which are deposited owing to a slowed-down flow of coolant in the longitudinal direction of the manifold and the differences in density and collect in the upper (geodetically upper) region of the manifold. The gaseous and the liquid phases are essentially separated in the reservoir space, a maximum liquid level occurring in the geodetically lower region of the manifold. The tube of the intake pipe dips into said liquid level, as mentioned, and extracts the liquid coolant. The overall arrangement therefore has the advantage that the coolant is deflected in a U shape in the manifold and thus passes over a relatively long path, which favors the separation gaseous and liquid phases.

According to one preferred embodiment, the filter device and/or drying device as well as the extraction device with stopper can be exchanged, i.e. they can be taken out of the manifold and replaced with serviced parts or new parts.

Further preferred embodiments provide for the filter device and/or drying device to be accommodated in a plastic housing and for the extraction pipe, like the stopper, to be manufactured from a plastic.

An exemplary embodiment of the invention is illustrated in the drawing and will be described in more detail below. In said drawing:

DETAILED DESCRIPTION

Figure 1:
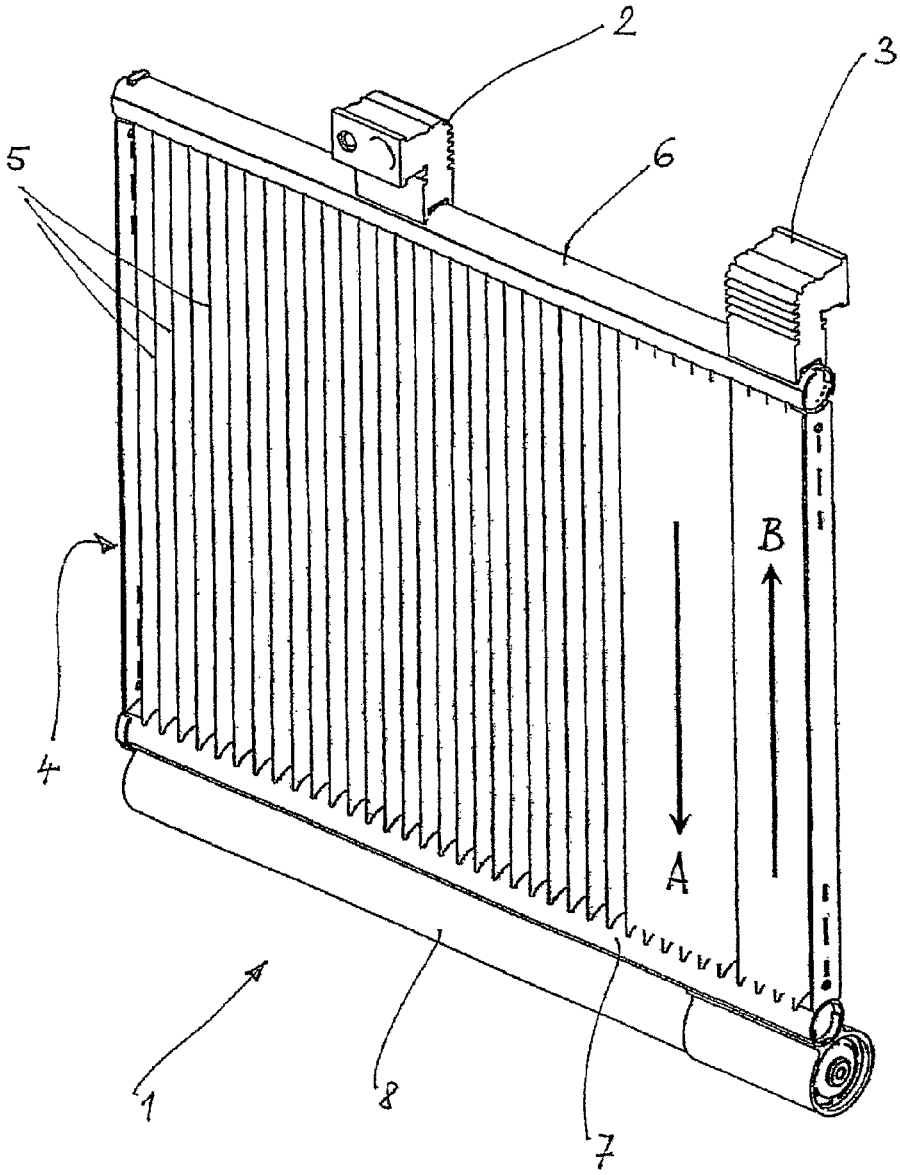
FIG. 1 shows a drop flow condenser with a manifold located at the bottom.

FIG. 1 shows a drop flow condenser 1 as a component of a coolant circuit (not illustrated) of a motor vehicle air conditioning system, the condenser 1 being connected to the coolant circuit by means of an inlet flange 2 and an outlet flange 3. The condenser 1 has a condenser network 4 with vertically arranged flat pipes 5 and corrugated ribs (not illustrated) which are arranged between the flat pipes 5 and around which ambient air flows. The flat pipes 5 through which coolant flows and which are preferably embodied as extruded multi-chamber pipes open with their pipe ends into an upper manifold pipe 6 which is arranged horizontally, and into a lower manifold pipe 7 which is arranged horizontally. A manifold 8 which communicates on the coolant side with the manifold pipe 7 (this communication not being illustrated here) is arranged underneath and parallel to the lower manifold pipe 7. The manifold pipes 6, 7 have dividing walls (not illustrated) in their interior so that a multi-current flow of the network 4 is obtained, the last but one pass being illustrated by an arrow A, and the last pass by an arrow B. The last pass corresponding to the arrow B comprises only a small number of pipes, for example four, and is referred to as a lower cooling section. Predominantly liquid coolant flows in this lower cooling section, which coolant is cooled below the condensation temperature and leaves adjacent to the condenser 1 via the exit flange 3.

Figure 2:
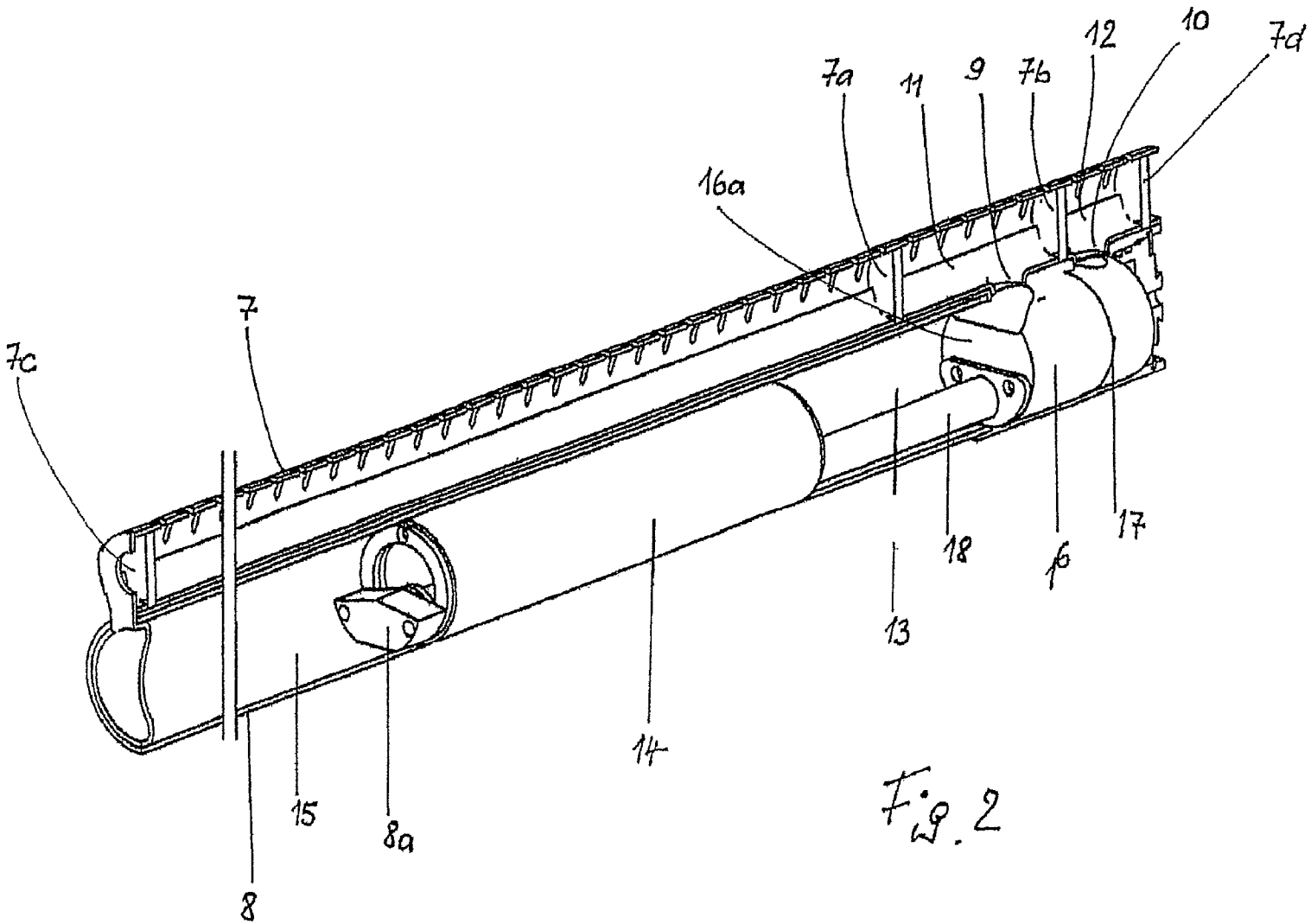
FIG. 2 is a perspective illustration of the cut-away manifold with manifold pipe.

FIG. 2 shows the manifold 8 which is located at the bottom, in conjunction with the lower manifold pipe 7 which is arranged parallel, both items being cut away in the longitudinal direction. The lower manifold pipe 7 has by way of example two dividing walls 7*a*, 7*b* and two terminating walls 7*c*, 7*d* and is embodied in two parts, i.e. divided in the longitudinal direction. The manifold 8, which has a somewhat larger cross section than the manifold pipe 7, is connected via an inflow opening 9 and an outflow opening 10 to the manifold pipe 7, and to a chamber 11 which communicates with the last but one pass corresponding to the arrow A, or to a chamber 12 which communicates with the lower cooling section B. For the rest, the design of the manifold pipe 7 and of the manifold 8 as well as the mechanical and coolant-end connection thereof are known from EP-A 1 310 748 by the applicant. The manifold 8 has an inflow-end chamber 13 which accommodates a filter device and/or drying device 14 which is adjoined by a reservoir chamber 15. In the region of the inflow and outflow openings 9, 10, a stopper 16 which is embodied approximately in the shape of a cylinder and is adapted to the cross section of the manifold 8 is arranged, said stopper 16 being sealed with respect to the inner wall of the manifold 8 around the circumference in the region of the dividing wall 7*b* by an O ring 17. The stopper 16 has an end wall 16*a* which bounds the inflow chamber 13 and to whose lower region an extraction pipe 18 is mounted, which extraction pipe 18 leads through the filter-drier device 14, extends into the reservoir chamber 15 and has a cover cap 18*a* (intake tube) at its end there.

Figure 3:
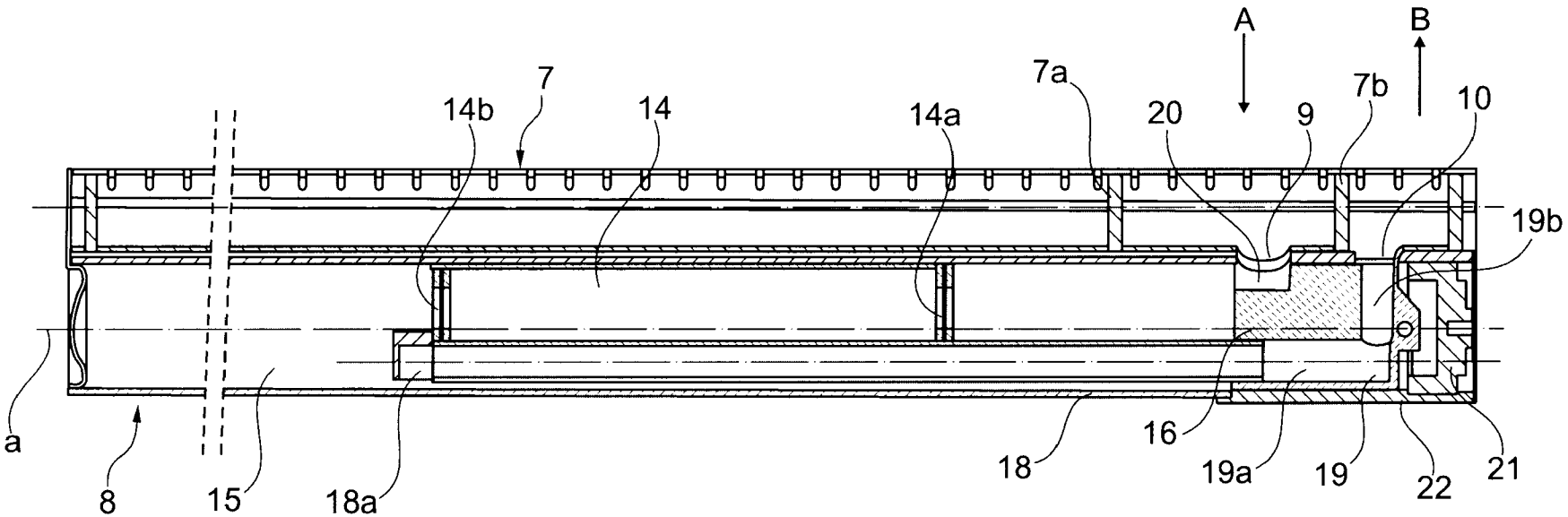
FIG. 3 shows a longitudinal section through the manifold with manifold pipe.

FIG. 3 shows the manifold 8 which has a longitudinal axis a, with the manifold pipe 7 in a longitudinal section, identical reference numerals being used for identical parts. The stopper 16 is essentially embodied as a solid plastic part which has a through-duct 19, composed of an axial bore 19*a* and a radial bore 19*b*, i.e. with a 90% deflection means. The extraction pipe 18 is connected to the axial bore 19*a* and leads through the filter-drier device 14. The end of the extraction pipe 18 which leads into the reservoir chamber 15 is covered by the downwardly open cap 18*a* and forms an intake tube. The radial bore 19*b* is aligned with the outflow opening 10 and thus communicates with the lower cooling section of the condenser (illustrated here by the arrow B). The stopper 16 also has, in the region of the inflow opening 9, a deflection surface or a cutout 20 which forms a connection between the inflow opening 9 and the inflow chamber 13. The filter-drier device 14 has an end inlet opening 14*a* and an end outlet opening 14*b* for the coolant in its geodetically upper region, i.e. approximately in the upper half of the manifold, and coolant can thus flow through it in the longitudinal direction of the manifold 8. For the rest, the filter-drier device 14 is known, in particular from the applicant's earlier application mentioned at the beginning, the content of which is incorporated entirely into the subject of the present application. As already mentioned, the extraction pipe 18, which is aligned with the axial bore 19*a*, is arranged geodetically at the bottom, i.e. at the lowest region of the manifold 8.

The manifold 8 can be closed by a detachable closure stopper 21, as is known, for example from DE-A 100 39 260 by the applicant. The stopper 16 can be secured axially via the closure stopper 21 in the manifold 8 by means of a connecting element 22. The stopper 16 and closure stopper 21 can also be embodied in one piece.

The function of the condenser according to the invention will be explained in the text which follows with reference to FIG. 3: the very largely condensed coolant of the last but one pass (arrow A) enters the inflow chamber 13 of the manifold 8 via the inflow opening 9, the coolant flow being decelerated due to the widening in cross section. The coolant, for example R134a, flows inevitably in the direction of the longitudinal axis a through the filter-drier device 14, where it is cleaned and dried. The coolant then enters the reservoir chamber 15, specifically into its upper region, with the gaseous and liquid phases being separated owing to the differences in density. The liquid coolant thus collects in the lower region of the manifold 8 and is drawn off there into the extraction pipe 18 via the intake tube 18*a*, and passes via the through-duct 19 with an upward 90° deflection into the manifold pipe 7 and thus into the lower cooling section (arrow B) of the condenser.

The coolant which enters the manifold 8 through the inflow opening 9 and exits again from the manifold 8 via the outflow opening 10 is therefore deflected on this path through 180° or in the shape of a U by virtue of the fact that it firstly flows from right to left in the upper region of the manifold 8 in the drawing and then from left to right in the drawing via the extraction pipe 18 after deflection in the lower region of the manifold 8. In the process, the gaseous and liquid phases are separated on the path in the upper region of the manifold 8 at a relatively low flow rate.

The invention claimed is:

1. A condenser for an air conditioning system, in particular for a motor vehicle, comprising pipes which are arranged vertically, through which a coolant flows and which have a coolant connection to an upper manifold pipe and a lower manifold pipe, said manifold pipes being respectively arranged horizontally, and having a manifold which is arranged parallel underneath the lower manifold pipe and has a coolant connection to the lower manifold pipe via an inflow opening and an outflow opening, a separating device being arranged between the inflow opening and the outflow opening, and a filter device and/or drying device arranged in the separating device and defining therein a reservoir chamber, the filter device and/or drying device being positioned between the inflow opening and the reservoir chamber, the separating device having an extractor device for carrying essentially fluid coolant from the reservoir chamber to the outflow opening, wherein the extractor device comprises an extraction pipe which is arranged in a gravitationally lowest region of the manifold, wherein the filter device and/or drying device defines a first flow path from the inflow opening to the reservoir chamber, and wherein the extraction pipe defines a second flow path from the reservoir chamber to the outflow opening.

2. The condenser as claimed in claim 1, wherein the extraction pipe extends in a longitudinal direction of the manifold and leads through the filter device and/or drying device.

3. The condenser as claimed in claim 1, wherein the separating device comprises a stopper with a through-duct which connects the outflow opening to the extractor device.

4. The condenser as claimed in claim 3, wherein the stopper is in the manifold in the region between the inflow opening and outflow opening, and is sealed around the circumference by means of a sealing ring.

5. The condenser as claimed in claim 3, wherein the through-duct is formed by a longitudinal bore and a transverse bore, the transverse bore being aligned with the outflow opening, and the longitudinal bore being aligned with the extractor device.

6. The condenser as claimed in claim 3, wherein the stopper has, in the region of the inflow opening, a cutout for diverting the flow in the longitudinal direction of the manifold.

7. The condenser as claimed in claim 1, wherein the manifold has the reservoir chamber at its end facing away from the inflow opening.

8. The condenser as claimed in claim 7, wherein inflowing coolant can flow through the filter device and/or drying device in a gravitationally upper region.

9. The condenser as claimed in claim 2, wherein the extraction pipe has an intake end which is arranged in the region which is gravitationally at the bottom of the supply chamber.

10. The condenser as claimed in claim 9, wherein the intake end comprises an intake tube.

11. The condenser as claimed in claim 1, wherein the filter device and/or drying device, the stopper and/or an intake pipe can be exchanged.

12. The condenser as claimed in claim 1, wherein the stopper and/or an intake pipe can be manufactured from plastic in one piece.

13. The condenser as claimed in claim 1, wherein the stopper comprises a closure stopper of the manifold.

14. The condenser as claimed in claim 1, wherein the extraction pipe extends through the filter device and/or drying device.

15. The condenser as claimed in claim 1, further comprising a dividing wall in the lower manifold pipe between the inflow opening and the outflow opening whereby communication between the inflow opening and the outflow opening is along the first flow path and the second flow path.

16. A condenser for an air conditioning system of a motor vehicle, comprising:

pipes arranged vertically on a motor vehicle and having upper and lower ends;

an upper manifold pipe in coolant communication with the upper ends of the pipes;

a lower manifold pipe in coolant communication with the lower ends of the pipes, said upper and lower manifold pipes being arranged horizontally on the motor vehicle;

a manifold arranged parallel under the lower manifold pipe and having a coolant connection to the lower manifold pipe via an inflow opening and an outflow opening;

a separating flow path defined in the manifold between the inflow opening and the outflow opening;

a filter device and/or drying device arranged along the separating flow path and defining a reservoir chamber in the manifold, the filter device and/or drying device being positioned between the inflow opening and the reservoir chamber; and an extractor device for carrying essentially fluid coolant from the reservoir chamber to the outflow opening, wherein the filter device and/or drying device defines a first flow path from the inflow opening to the reservoir chamber, and wherein the extraction pipe defines a second flow path from the reservoir chamber to the outflow opening, the first flow path and the second flow path defining the separating flow path.

17. The condenser as claimed in claim 16, wherein the extraction pipe extends through the filter device and/or drying device.

18. The condenser as claimed in claim 16, further comprising a dividing wall in the lower manifold pipe between the inflow opening and the outflow opening whereby communication between the inflow opening and the outflow opening is along the first flow path and the second flow path.

* * * * *